US006399262B1

(12) United States Patent
Oshiba et al.

(10) Patent No.: US 6,399,262 B1
(45) **Date of Patent: *Jun. 4, 2002**

(54) ELECTROPHOTOGRAPHIC PHOTORECEPTOR

(75) Inventors: Takeo Oshiba; Akihiko Itami; Tomoo Sakimura; Yohko Kitahara; Masahiko Kurachi; Kazuhisa Shida, all of Hachioji (JP)

(73) Assignee: Konica Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/534,200

(22) Filed: Mar. 24, 2000

(30) Foreign Application Priority Data

Mar. 30, 1999 (JP) ..... 11-088574
Mar. 30, 1999 (JP) ..... 11-088575

(51) Int. Cl.[7] ..... G03G 5/047

(52) U.S. Cl. ..... 430/58.2; 430/65; 430/66; 430/69; 430/96; 430/970

(58) Field of Search ..... 430/56, 66, 67, 430/58.2, 64, 65, 69, 970, 96, 59.6, 58.4, 58.7

(56) References Cited

U.S. PATENT DOCUMENTS 4,943,501 A * 7/1990 Kinoshita et al. ..... 430/60
5,188,916 A * 2/1993 Hodumi et al. ..... 430/65
5,292,603 A * 3/1994 Sakai et al. ..... 430/18
5,549,997 A * 8/1996 Matsushima et al. ..... 430/83
5,800,956 A * 9/1998 Minemura et al. ..... 430/60
5,879,847 A * 3/1999 Yoshinaga et al. ..... 430/67
6,051,357 A * 4/2000 Matsui et al. ..... 430/131
6,143,452 A * 11/2000 Sakimura et al. ..... 430/58.2
6,265,122 B1 * 7/2001 Itami et al. ..... 430/58.2

FOREIGN PATENT DOCUMENTS

JP 6-118681 * 4/1994
JP 9-124943 * 5/1997
JP 9-190004 * 7/1997

* cited by examiner

*Primary Examiner*—Janis L. Dote
(74) *Attorney, Agent, or Firm*—Bierman, Muserlian and Lucas

(57) ABSTRACT

An electrophotographic photoreceptor is disclosed. The photoreceptor has a photosensitive layer provided on an electrically conductive support which has a sealed alumite film, a surface layer of said electrophotographic photoreceptor comprises a hardenable siloxane resin having charge transportability or a hardenable siloxane resin comprising a partial structure having charge transportability.

16 Claims, 2 Drawing Sheets

ELECTROPHOTOGRAPHIC PHOTORECEPTOR

FIELD OF THE INVENTION

The present invention relates to an electrophotographic photoreceptor (hereinafter occasionally referred simply to as a photoreceptor), and a processing cartridge as well as an image forming apparatus using said photoreceptor.

BACKGROUND OF THE INVENTION

In recent years, as electrophotographic photoreceptors, organic photoreceptors comprising organic photoconductive materials have been most widely employed. The organic photoreceptors are superior to other photoreceptors in such a manner that it is easier to develop materials in response to various types of exposure light sources ranging from visible light to infrared light; it is possible to select materials which result in no environmental pollution; the production cost is lower; and the like. However, only one problem of the organic photoreceptors is mechanically weak and during copying a large volume as well as during printing, the photoreceptor surface results in degradation as well as abrasion.

Such photoreceptors are generally prepared employing the following method. A charge generating layer is prepared by vacuum-evaporating organic charge generating materials onto an electrically conductive support which is comprised of aluminum or an aluminum alloy, or by applying a coating composition prepared by mixing organic charge generating materials with organic polymeric resins as the binding agent onto said support. Subsequently, a charge transport layer is formed by applying a coating composition, prepared by mixing organic charge transport materials and organic polymeric resins as the binding agent with a solvent onto the resulting charge generating layer.

In recent years, demand for electrophotographic image forming apparatuses has become more stringent in regard to image quality. Specifically, for reversal development type printers such as LD and LED printers and the like, still higher printing quality is desired. For instance, it is desired to eliminate minute black points (so-called black spots), which are formed on white backgrounds, and the like.

Generally, in electrophotographic copiers utilizing the Carlson method, after uniformly charging a photoreceptor, the resulting charge is eliminated imagewise by exposure to form an electrostatic latent image, which is developed employing toner and visualized. Subsequently, the toner is transferred onto paper and the like, and then fixed.

However, all toner on the photoreceptor is not transferred and a small portion of the toner remains on the photoreceptor. When images are repeatedly formed in such a state, the residual toner adversely affects the formation of the latent images. As a result, it is impossible to obtain high quality image copies without staining. Therefore, it is required to remove the residual toner. Representative cleaning means include a fur brush, a magnetic brush, a blade, and the like. Of these, a blade is mainly employed from the viewpoint of the performance, constitution, and the like. As the blade member, a plate-shaped rubber elastic body is generally employed.

As described above, electrical and external mechanical forces are directly applied to the surface of the electrophotographic photoreceptor through the charging unit, the development unit, the transfer means, the cleaning unit, and the like. Accordingly, durability against these processes is essential. Specifically, mechanical durability is required to counter the wear and abrasion of the photoreceptor surface due to sliding, as well as film peeling and the like, due to impact and the like, during corrective action to remove foreign matter and undo paper jams. Of these, durability similar to inorganic photoreceptors is strongly demanded against flaws due to impact, as well as film peeling.

In order to realize the various desired properties as described above, heretofore, various items have been investigated.

In order to improve the aforementioned image quality, proposed is a photoreceptor in which an alumite layer as a boundary blocking layer, which retards charge injection to the photosensitive layer, is formed on the surface of the aluminum base plate as the electrically conductive support. When such an alumite layer is employed, image quality, due to reduction of black spots and the like, is improved. However, since its close adhesion with the photosensitive layer decreases, durability of the photosensitive layer surface against external mechanical force also decreases. As a result, problems such as flaws, as well as film peeling, occur. It has been difficult to dissolve such problems of the film peeling caused by decrease of close adhesion with the photosensitive layer.

As far as the durability against mechanical force concerns, it is reported that wear resistant properties of the surface, as well as toner filming properties, are improved by employing BPZ polycarbonate as the binder (a binding resin) on the surface of the organic photoreceptor. Further, Japanese Patent Publication Open to Public Inspection No. 6-118681 discloses colloidal silica containing hardenable silicone resin employed as the protective surface layer of a photoreceptor.

However, a photoreceptor comprising the bisphenol Z type polycarbonate binder exhibits insufficient wear resistant properties and also does not exhibit sufficient durability. On the other hand, improved are wear resistant properties of the surface layer comprised of the colloidal silica containing hardenable silicone resin. However, electrophotographic properties are unsatisfactory during repeated use, and background staining as well as blurred images tends to occur. Thus, this method does not exhibit sufficient durability. Namely durability is not insufficient in each case, particularly it is difficult to prevent peeling due to deterioration of sdhesion of alumite layer and the photosensitive layer.

Japanese Patent Publication Open to Public Inspection Nos. 9-124943 and 9-190004 disclose a photoreceptor having as the surface layer, a resin layer in which an organic silicone modified positive hole transport compound is bonded to a hardenable organic silicone based polymer. However, said resin layer tends to form background staining as well as blurred images at a relatively high humid ambiance. Thus sufficient durability is not obtained. Further, said hardenable organic silicone compound film exhibits high wear resistant properties. However, since said film tends to suffer from flaws due to external impact and tends to peel, its strength, as well as adhesion, is not sufficient.

Further, accompanying the recent progress of digital technology, in the image forming methods employing electrophotography, image exposure utilizing an interfering light source has been the main process. Thus, desired has been the development of a photoreceptors which are suitable for such an interfering light source and do not form an interference moire; exhibit high wear resistance, and neither suffer from flaws nor peel due to external impact; and further does not form blurred images.

SUMMARY OF THE INVENTION

It is an object of the present invention to dissolve problems caused by decrease of close adhesion of the photosensitive layer with alumite layer. For this purpose, it is the object to provide a photoreceptor having high surface hardness. It is an object of the present invention to provide, while overcoming the problems described above, an electrophotographic photoreceptor which exhibits high surface hardness, high wear resistance, and high flaw resistance; exhibits consistent electrophotographic properties at high temperature and humidity during repeated use, and accordingly, repeatedly produces excellent images, and does not form a moire during the formation of digital images employing a laser beam and the like, and further to provide a processing cartridge as well as an image forming apparatus employing said photoreceptor.

The inventors of the present invention have endeavored to overcome the problems described above, in particular to maintain close adhesion of the photosensitive layer even when alumite is employed. As a result, it was discovered that the purpose of the present invention was achieved, that is, to dissolve close adhesion of the photosensitive layer with alumite layer, namely film peeling, by enhancing surface hardness of the photoreceptor in which a specified resin layer. Doubt to tear the surface layer of the photoreceptor by, for example, cleaning blade decreases, and stress does not applied to the alumite layer and photosensitive layer because the specified resin layer has high hardness. Conventional problems have been improved by this.

Further, degree of light scattering is controlled by maintaining surface roughness of substrate of the photoreceptor beneath photosensitive layer within predetermined surface roughness for the purpose of preventing occurrence of moire in forming digital image employing laser light etc. However the above mentioned surface roughness of the substrate of the photoreceptor itself induces asperity at the surface of the substrate. In such condition cleaning blade should be pressed by strong pressure to the photoreceptor to perform sufficient cleaning. It has been found that wear and film peeling of photoreceptor surface are dissolved by forming a specified resin layer on the surface of the photoreceptor. In the present invention it becomes possible that problems such as durability and film peeling as well as preventing occurrence of moire by a combination of controlling surface roughness of substrate and the above mentioned specified resin layer.

The invention and its embodiments are described below.

In an electrophotographic photoreceptor comprising an electrically conductive support having thereon a photosensitive layer, an electrophotographic photoreceptor wherein the surface layer of said electrophotographic photoreceptor comprises a hardenable siloxane resin having charge transportability, and said electrically conductive support comprises on its surface a sealed alumite film.

In an electrophotographic photoreceptor comprising an electrically conductive support having thereon a photosensitive layer, an electrophotographic photoreceptor wherein the surface layer of said electrophotographic photoreceptor comprises a hardenable siloxane resin comprising a partial structure having charge transportability and said electrically conductive support comprises on its surface a sealed alumite film.

Said partial structure having charge transportability is preferably represented by the structural formula described below.

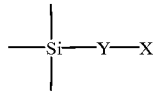

wherein X represents a charge transportability providing group which bonds to Y via a carbon atom constituting of said providing group, and Y represents a divalent or higher valent atom or group excluding adjacent bonding atoms (Si and C).

Said partial structure having charge transportability is preferably represented by the structural formula shown below.

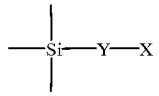

wherein X is a charge transportability provided group, which bonds to Y via a carbon atom constituting said providing group, and Y represents an oxygen, a sulfur atom, or NR, wherein R represents a hydrogen atom or a univalent organic group.

In an electrophotographic photoreceptor comprising an electrically conductive support having thereon a photosensitive layer, an electrophotographic photoreceptor wherein the surface layer of said electrophotographic photoreceptor is comprised of a resin layer containing a hardenable siloxane resin obtained by allowing an organic silicon compound having a hydroxyl group, or a hydrolyzable group, to react with a charge transferable compound having a hydroxyl group, and said electrically conductive support comprises on its surface a sealed alumite film.

In an electrophotographic photoreceptor, comprising an electrically conductive support having thereon a photosensitive layer, an electrophotographic photoreceptor wherein the surface layer of said electrophotographic photoreceptor is comprised of a resin layer containing a hardenable siloxane resin obtained by allowing an organic silicon compound having a hydroxyl group or a hydrolyzable group to react with a charge transferable compound having an amino group, and said electrically conductive support comprises on its surface a sealed alumite film.

In an electrophotographic photoreceptor comprising an electrically conductive support having thereon a photosensitive layer, an electrophotographic photoreceptor wherein the surface layer of said electrophotographic photoreceptor is comprised of a resin layer containing a hardenable siloxane resin obtained by allowing an organic silicon compound having a hydroxyl group or a hydrolyzable group to react with a charge transferable compound having a mercapto group, and said electrically conductive support comprises on its surface a sealed alumite film.

An electrophotographic photoreceptor wherein said resin layer containing a hardenable siloxane resin is hardened.

An electrophotographic photoreceptor wherein said photosensitive layer is comprised of a charge generating layer as well as a charge transport layer.

An electrophotographic photoreceptor wherein said photosensitive layer is comprised of a charge generating layer as well as a charge transport layer.

An electrophotographic photoreceptor wherein an interlayer is provided between said electrically conductive support and said photosensitive layer.

An electrophotographic photoreceptor wherein the thickness of said surface layer is between 0.1 and 20 μm.

An electrophotographic photoreceptor wherein an adhesive layer is provided between said surface layer and the adjacent layer.

An electrophotographic photoreceptor wherein said charge transportability providing group is a triarylamine based compound residual group.

An electrophotographic photoreceptor wherein said charge transportability providing group is a hydrazone based compound residual group.

An electrophotographic photoreceptor wherein said charge transportability providing group is a styryltriphenylamine based compound residual group.

An electrophotographic photoreceptor wherein said charge transportability providing group is a benzidine based compound residual group.

An electrophotographic photoreceptor wherein said charge transportability providing group is a butadiene based compound residual group.

An electrophotographic photoreceptor wherein said interlayer is a resin layer.

An electrophotographic photoreceptor wherein said interlayer is a resin layer formed by allowing an organic metal compound to react with an organic metal chelate compound.

An electrophotographic photoreceptor wherein said electrophotographic photoreceptor comprises an antioxidant.

An electrophotographic photoreceptor wherein said antioxidant is a compound having a partial structure of hindered phenol, hindered amine, thioether, or phosphite.

An image forming apparatus wherein an electrophotographic photoreceptor is employed, and an image is formed through charging, image exposure, development, transfer, separation, and cleaning.

Ten points average surface roughness (Rz) of the conductive support is preferably not less than 0.3 μm and not more than 2.5 μm.

In a processing cartridge employed in an image forming apparatus which carries out the processes of charging, image exposure, development, transfer, separation, and cleaning while employing an electrophotographic photoreceptor, a processing cartridge which is produced by combining said electrophotographic photoreceptor with at least one of any of a charging unit, an image exposure unit, a development unit, or a cleaning unit.

DETAILED DESCRIPTION OF THE INVENTION

Figure 1:
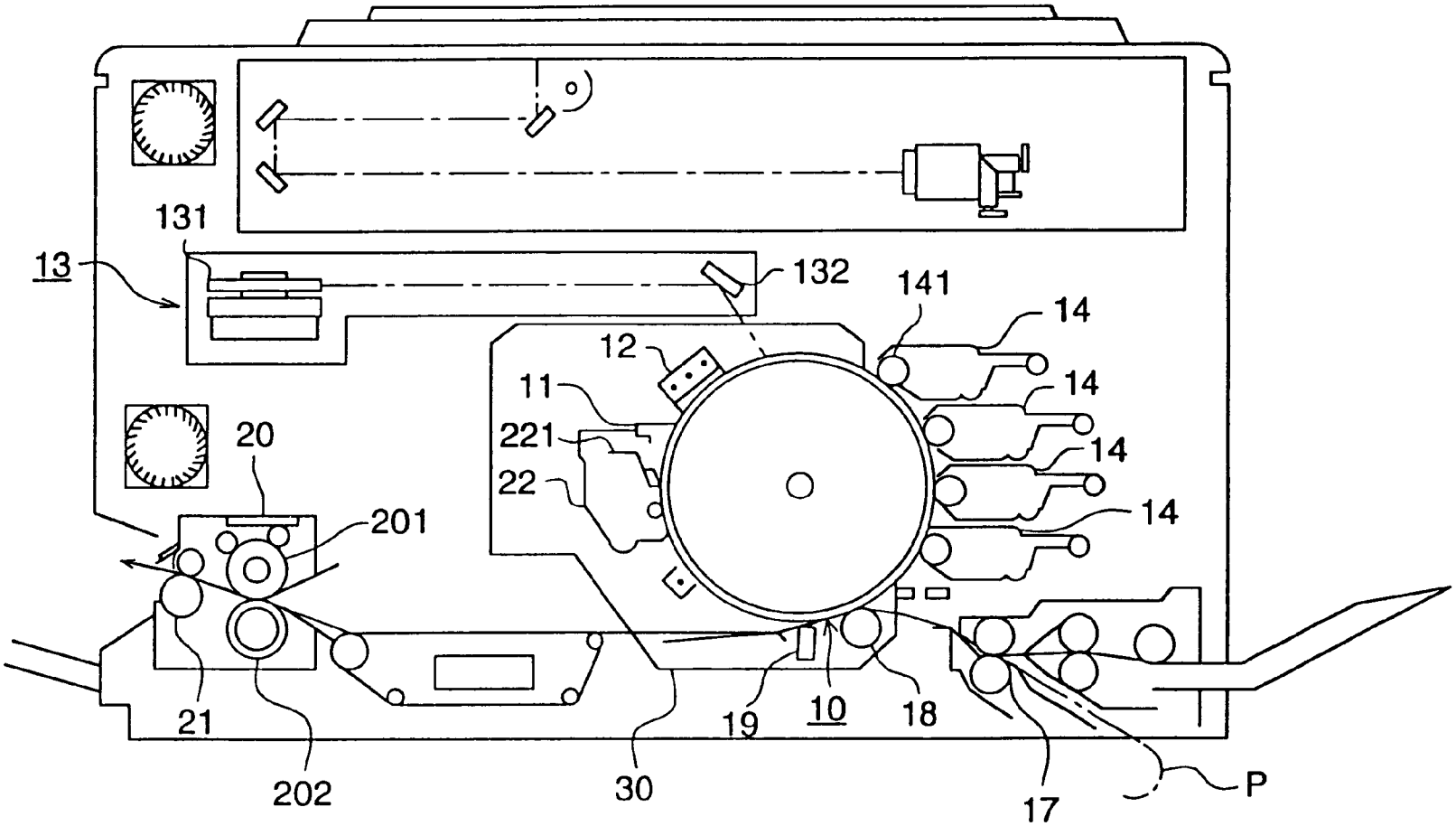
FIG. 1 is a cross-sectional view showing one example of an image forming apparatus comprising the electrophotographic photoreceptor of the present invention.

In the invention, the cross-linked siloxane resin having the charge transportable structural unit can be prepared by a known method using an organic silicon compound having hydroxyl group or a hydrolyzable group. Such the organic silicon compound is represented by the following Formula A, B, C or D.

Formula A

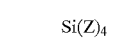

$Si(Z)_4$

-continued

Formula B

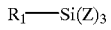

$R_1—Si(Z)_3$

Formula C

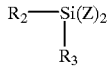

$R_2—Si(Z)_2$ (with $R_3$)

Formula D

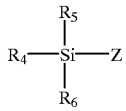

$R_4—Si(R_5)(R_6)—Z$

In the formulas, $R_1$ through $R_6$ are each an organic group in which a carbon atom thereof is directly boned with the silicon atom in the formula, Z is a hydroxyl group or a hydrolyzable group.

When Z in the above formulas is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by $R_1$ through $R_6$ in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β-(3,4-epoxycyclohexyl) ethyl group, an (metha)acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a nonafluorohexyl group and perfluorooctylethyl group, and an alkyl group substituted by a nitro group or a cyano group. The organic groups represented by $R_1$ through $R_6$ may be the same as or different from each other.

Generally, the reaction of the organic siloxane compound for making a high molecular weight is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling such the factors can control the storage ability of the coating liquid of the layer and the hardness of the coated layer.

The siloxane resin of the invention is a resin which is formed and hardened by a reaction (including a hydrolyzing, and a reaction in the presence of a catalyst or a cross-linking agent) of a monomer, an oligomer or a polymer having a siloxane bond in the chemical structural thereof unit to form a three-dimensional network structure.

In another words, the siloxane resin of the invention means a cross-linked siloxane resin formed as a result of the formation of three-dimensional network structure by acceleration of siloxane bonding formation of the organic compound having a siloxane bond by a hydrolyzing reaction and a dehydrating reaction.

Moreover, the siloxane resin may be a resin containing a silica particle as a part of the cross-linked structure by adding a colloidal silica particle having a hydroxyl group or a hydrolyzable group.

In other definition, the charge transportable structural unit is a chemical structural unit or a residue of charge transportable compound by which an electric current caused by charge transportation can be detected by a known method for detecting the charge transportation ability such as Time-Of-Flight method.

The charge transportable structural unit is a chemical structural unit or a residue of charge transportable compound showing an electron or hole mobility. In the invention the cross-linked siloxane resin having a charge transportable structural unit is a siloxane resin in which a chemical structure showing a drift mobility of electron or a hole (i.e., the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

Examples of hole transporting type CTM which each are contained in the siloxane resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM which each are contained in the siloxane resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalononitrile, polynitro-9-fluorenylidenedicyanomethylenemalonodinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and meritic acid.

In the invention, preferable charge transportable structural units are residues of usually used charge transporting compounds such as mentioned above. The residue is bonded with the bonding atom or group represented by Y through the carbon atom or the silicon atom constituting the charge transporting compound so as to be contained in the siloxane resin.

Formula 1

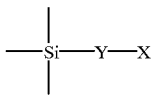

In the formula, Y is a bonding group having two or more valences.

When Y is three or more valent atom, the bonding hand other than those each bonding with Si and C is bonded with any atom constituting the hardened resin, or another atom or molecular group.

In the above-mentioned formula, the atom represented by Y is preferably an oxygen atom O, a sulfur atom S or nitrogen atom N.

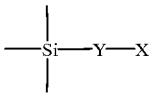

In the Formula, X is a group having a charge transporting ability and bonding to Y in the formula, and Y is an oxygen atom (O), sulfur atom (S) or —NR—, in which R is a hydrogen atom or a mono-valent organic group.

Although the charge transportable structural unit X is shown as a mono-valent group in the formula, the structural unit may be bonded as a two or more valences cross-linking group in the hardened resin or as a simple pendant group when the charge transporting compounds to be reacted with the siloxane resin has two or more functional groups.

The O, S or N atoms is a bonding atom or group for taking the charge transportable structural unit into the siloxane resin, which is formed by reaction of a hydroxyl group, mercapto group or amine introduced into the charge transportable compound with the organic silicon compound having a hydroxyl group or a hydrolyzable group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also compounds having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$$X—(R_7—OH)_m \quad m \geqq 1$$

wherein

X: structural unit providing charge transportability $R_7$: single bonding group, each of a substituted or an unsubstituted alkylene or arylene group m: preferably 1 to 5

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds
T-1
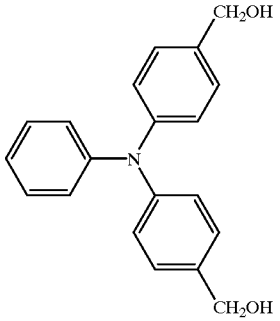
T-2
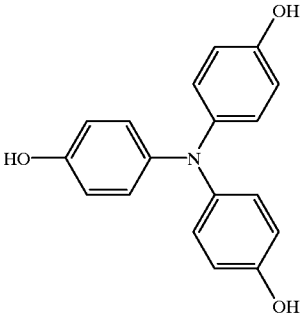
T-3
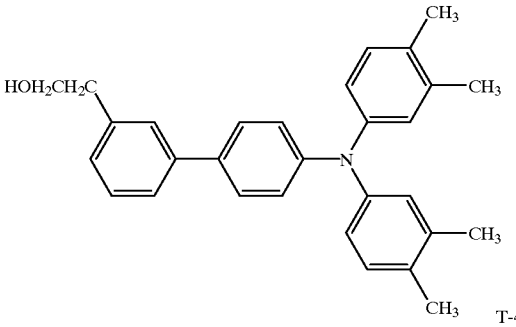
T-4
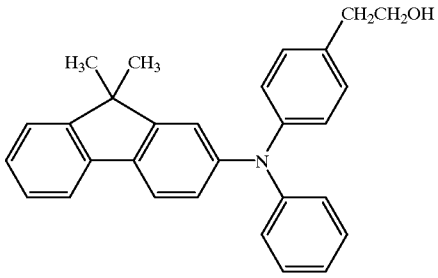
2. Hydrazine Based Compounds
H-1
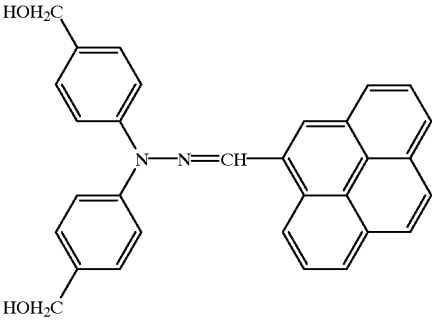
-continued
H-2
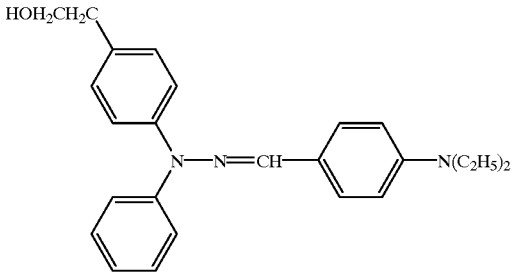
H-3
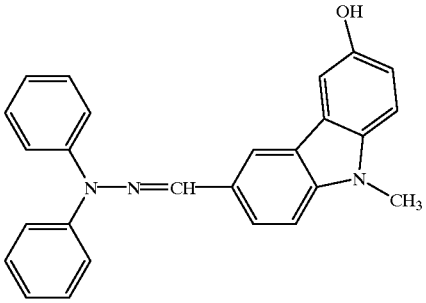
3. Stilbene Based Compounds
S-1
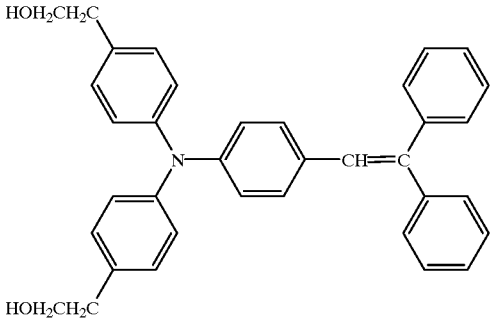
S-2
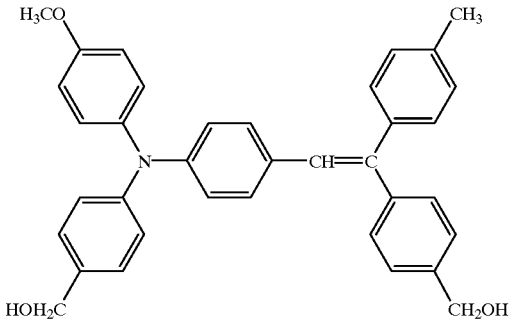

-continued
S-3
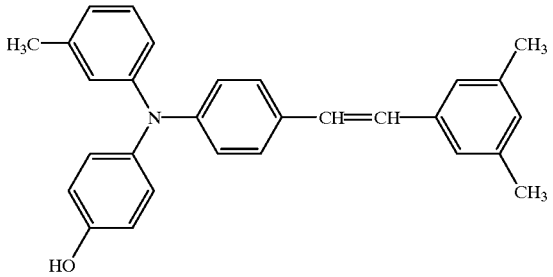
4. Benzidine Based Compounds
Be-1
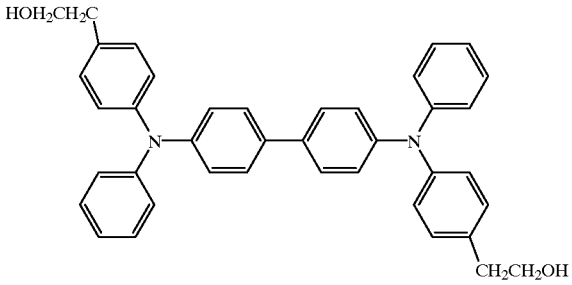
Be-2
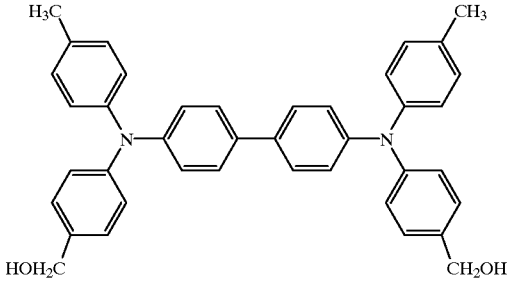
5. Butadiene Based Compounds
Bu-1
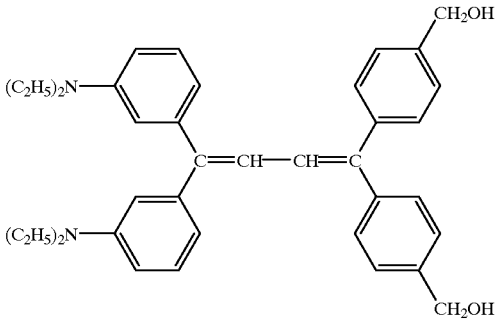
6. Other Compounds
So-1
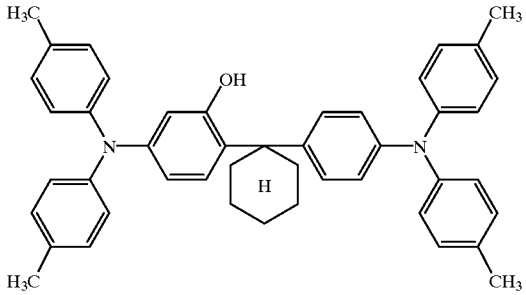
So-2
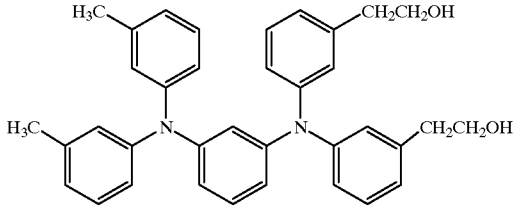
Next, a synthesis example of the charge transportable compound will be described.
Synthesis of Exemplified Compound T-1
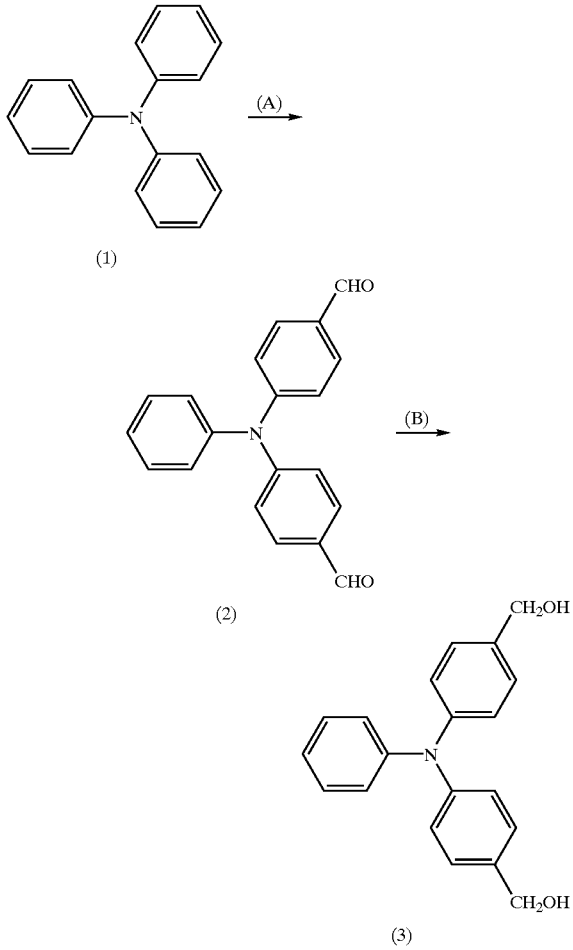

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the same, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

Synthesis of Exemplified Compound S-1

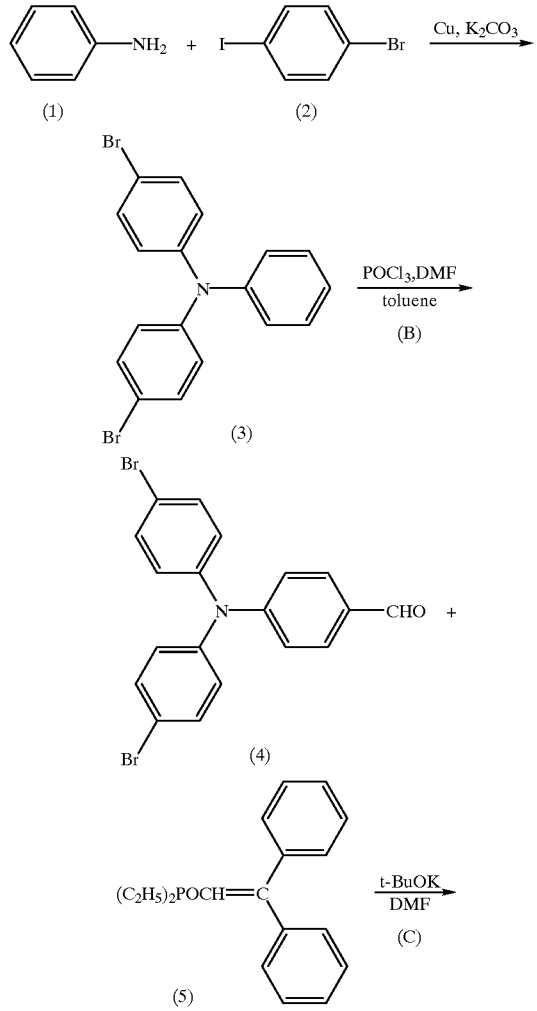

-continued

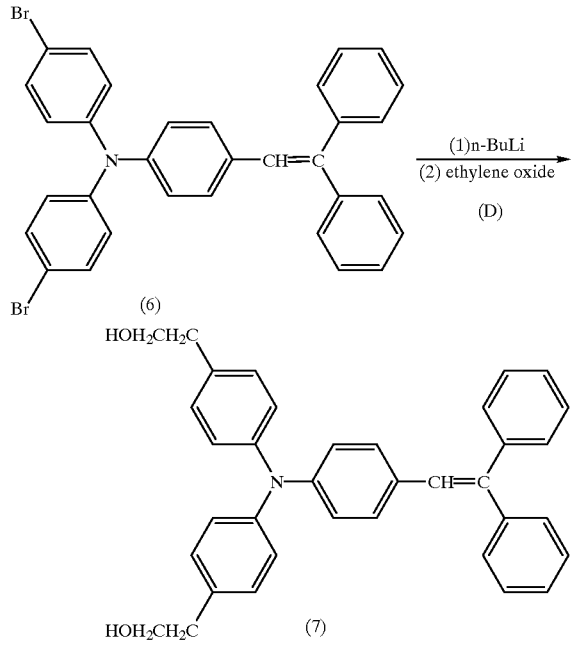

Step A

Placed in a 300 ml flask equipped with a thermometer and a stirrer were 30 g of Cu, 60 g of $K_2CO_3$, 8 g of Compound (1), and 100 g of Compound (2) and the resulting mixture was heated to about 180° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R_8—SH)_m m \geqq 1$$

wherein

X: charge transportability providing group $R_8$: single bonding group, each of a substituted or an unsubstituted alkylene group or an arylene group m: preferably 1 to 5

Of these, listed as representative compounds are such as those described below.

V-1

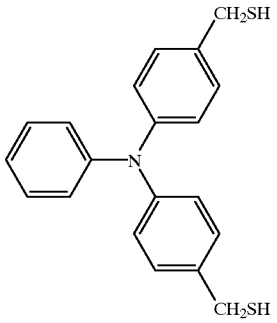

V-2

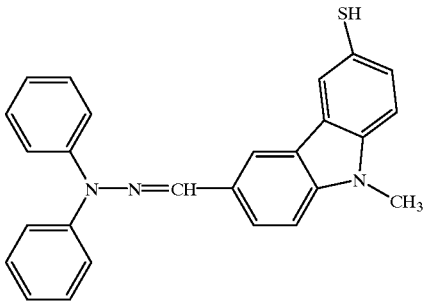

-continued

V-3

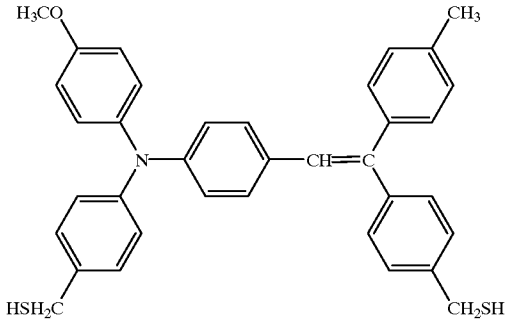

V-4

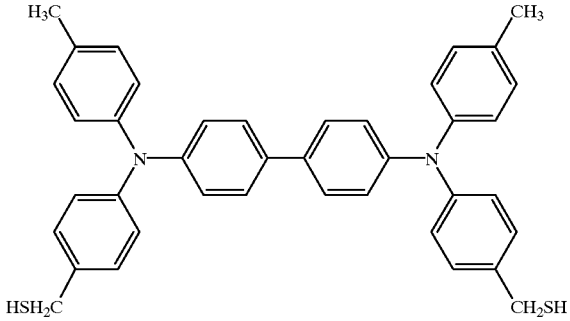

V-5

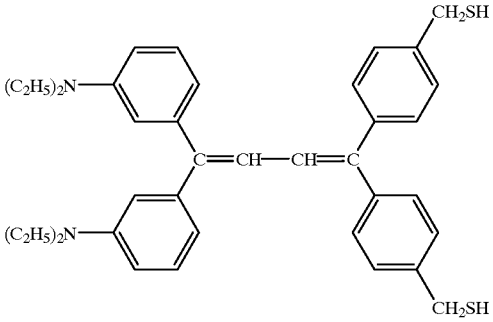

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_9—NR_{10}H)_m m \geqq 1$$

wherein

X: charge transportability providing group $R_9$: single bonding group, each of a substituted or an unsubstituted alkylene group or an arylene group $R_{10}$: H, a substituted or unsubstituted alkyl group, a substituted or an unsubstituted aryl group m: 1 to 5

Of these, listed as representative compounds are such as those described below.

W-1

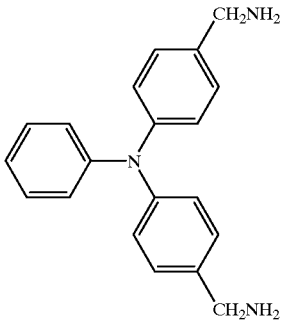

W-2

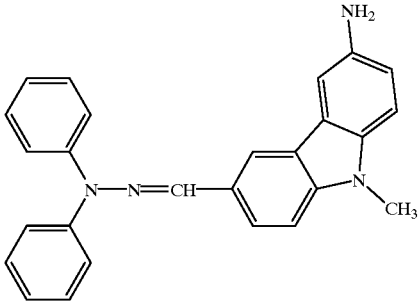

W-3

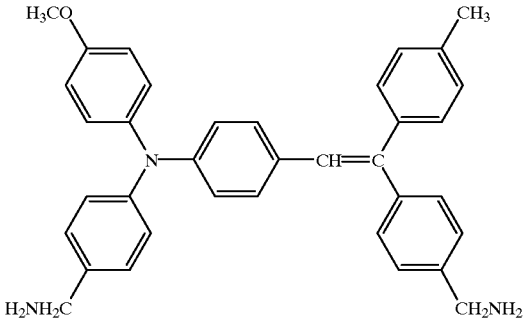

W-4

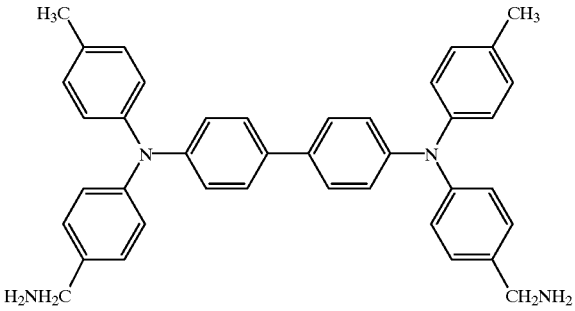

W-5

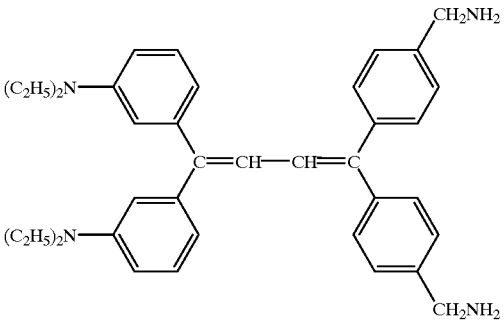

-continued

W-6

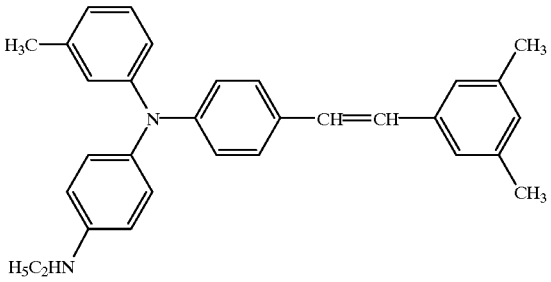

Of charge transportable compounds having an amino group, in the case of primary amine compounds (—$NH_2$), two hydrogen atoms may react with the organic silicone compound, and bonding to the siloxane structure may take place. In the case of secondary amine compounds (—$NHR_{10}$), one hydrogen atom may react with the organic silicone compound, and the remaining $R_{10}$ may be any of a remaining group as a branch, a group resulting in a crosslinking reaction, or a compound group having charge transportability.

Raw materials of the siloxane resin: The compounds represented Formula A through D (hereinafter referred to A through D) respectively. The ratio of those is preferably to use organic silicon compound: from 0.05 to 1 moles of C+D component per 1 mole of A+B component.

When colloidal silica E is added, it is preferable to use from 1 to 30 parts by weight of E per 100 parts by weight of total amount of A+B+C+D component.

The adding amount of the reactive charge transportable compound F capable of forming the resin layer by reacting with the organic silicon compound and the colloidal silica is preferably from 1 to 500 parts by weight per 100 parts by weight of the total amount of the component of A+B+C+D. When the amount of A+B component is smaller than the above-mentioned range, the hardness of the siloxane resin layer is shortened since the cross-linking density is too low. When the amount of A+B component is too large, the hardness of the layer is sufficient but the layer is become fragile. A shortage and an excess of the colloidal silica component E show similar effects to those of the component A+B, respectively. A too small amount of component F causes lowering in the sensitivity and raising in the remained potential since the charge transporting ability of the siloxane resin layer is become too low. When the amount of component F is excessive, the strength of the resin layer tends to be lowered.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Usually, the three-dimensional network structure can be formed by a condensation reaction of a composition containing alkoxysilane or alkoxysilane and colloidal silica.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octate, dibutyl tin dictate, dibutyl tin dilaurate, dibutyl tin mercaptide, dibutyl tin thiocarboxylate and dibutyl tin maleate, an aluminum or zinc salt of octenic acid or naphthenic acid and an acetylacetone complex.

Further, antioxidants having a partial structure of hindered phenol, hindered amine, thioether, or phosphite may be incorporated into the resin layer of the present invention, and are effective for the improvement of potential stabilization during ambient variation, as well as image quality.

The hindered phenols as described herein means compounds having a branched alkyl group in the ortho position relative to the hydroxyl group of a phenol compound and derivatives thereof. (However, the hydroxyl group may be modified to an alkoxy group.)

Further, listed as hindered amines are compounds having an organic group represented by the following structural formula:

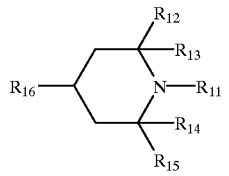

wherein $R_{11}$ represents a hydrogen atom or an univalent organic group, $R_{12}$, $R_{13}$, $R_{14}$, and $R_{15}$ each represents an alkyl group, and $R_{16}$ represents a hydrogen atom, a hydroxyl group, or If a univalent organic group.

Listed as antioxidants having a partial hindered phenol structure are compounds described in Japanese Patent Publication Open to Public Inspection No. 1-118137 (on pages 7 to 914).

Listed as antioxidants having a partial hindered amine structure are compounds described in Japanese Patent Publication Open to Public Inspection No. 1-118138 (on pages 7 to 9).

The representative compounds are exemplified below.

1-1

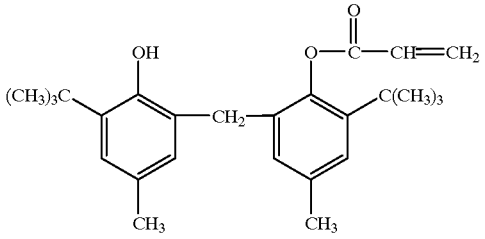

1-2

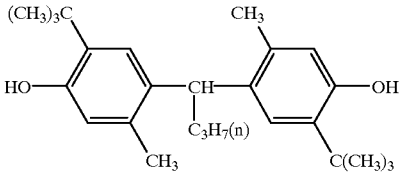

1-3

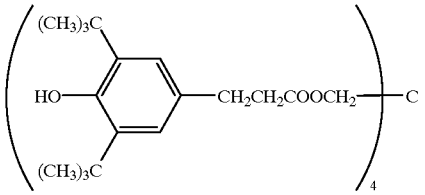

1-4

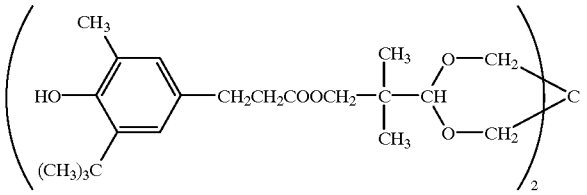

-continued
1-5
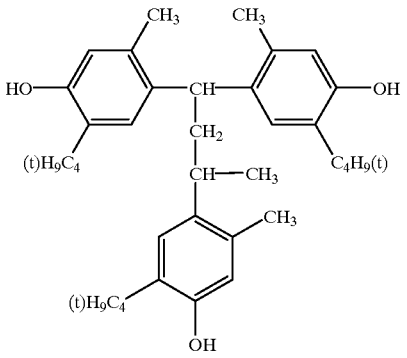
1-6
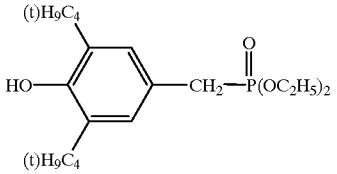
1-7
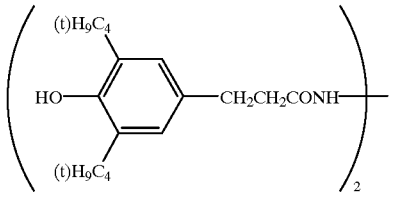
1-8
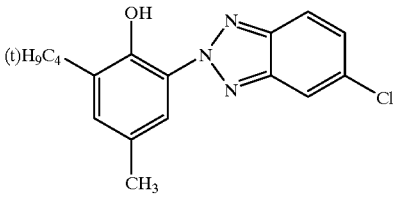
1-9
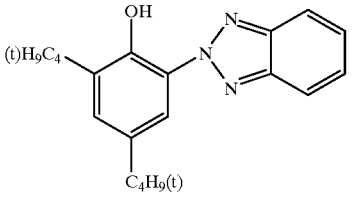
1-10
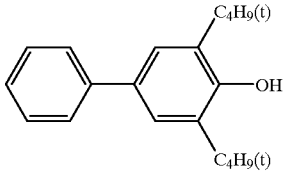

-continued
2-1
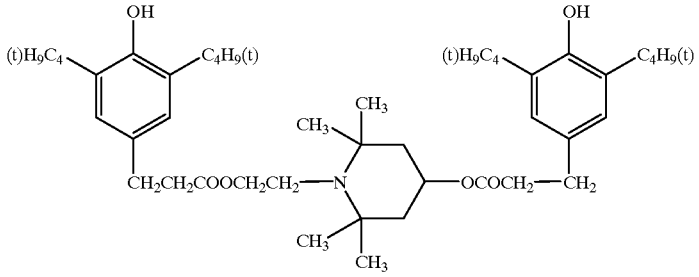
2-2
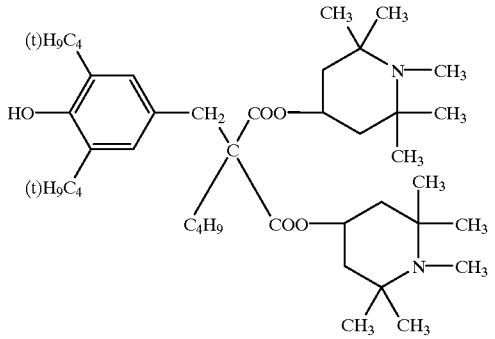
2-3
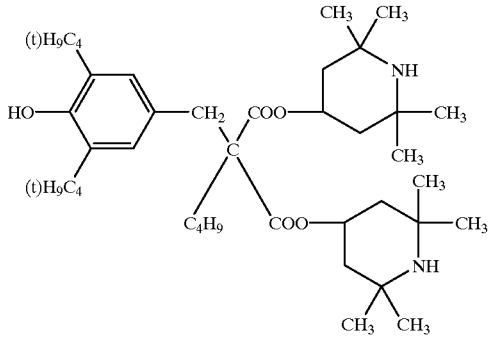
2-4
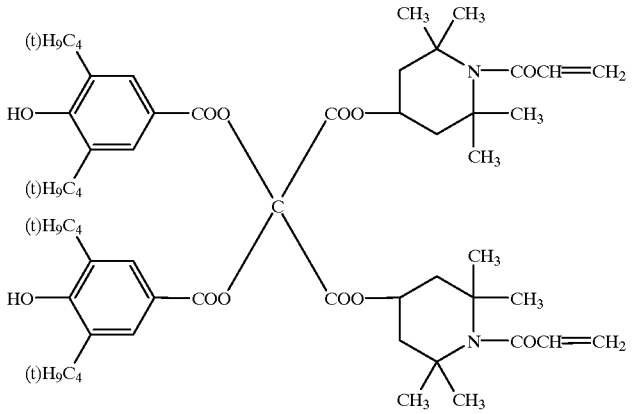
2-5
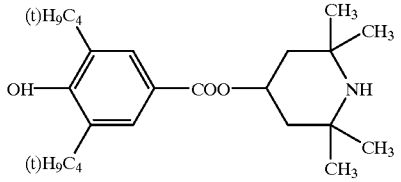

-continued
2-6
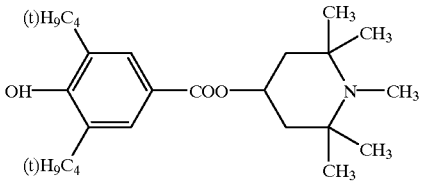
2-7
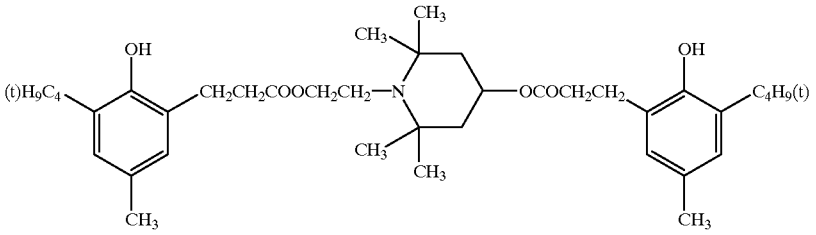
3-1
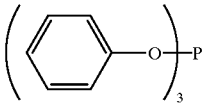
3-2
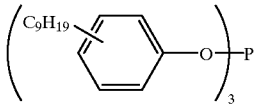
3-3
$(C_2H_5O)_3P$
3-4
$(C_8H_{17})_3P$
3-5
$(C_{10}H_{21}O)_3P$
3-6
$(C_{13}H_{27}O)_3P$
3-7
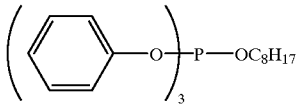
3-8
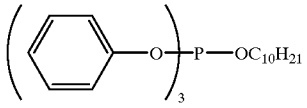
3-9
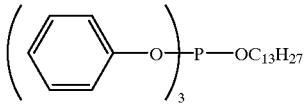
3-10
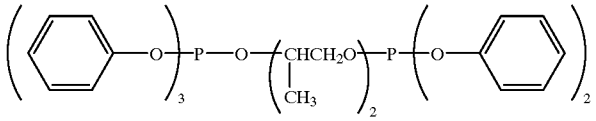
3-11
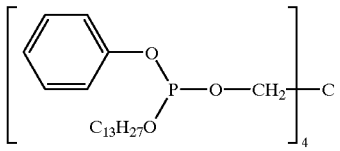

-continued 3-12

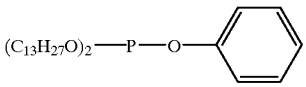

4-1

$(C_8H_{17}OCOCH_2CH_2)_2S$ 4-2

$(C_{10}H_{21}OCOCH_2CH_2)_2S$ 4-3

$(C_{12}H_{25}OCOCH_2CH_2)_2S$ 4-4

$(C_{14}H_{29}OCOCH_2CH_2)_2S$ 4-5

$(C_{18}H_{37}OCOCH_2CH_2)_2S$ 4-6

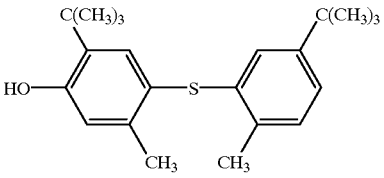

Examples of antioxidant available on the market include the followings.

Hindered phenol type antioxidant: ILGANOX 1076, ILGANOX 1010, ILGANOX 1098, ILGANOX 245, ILGANOX 1330, ILGANOX 3114, and 3,5-di-t-butyl-4-hydroxbiphenyl.

Hindered amine type antioxidant: SANOL LS2626, SANOL LS765, SANOL LS770, SANOL LS744, TINUVIN 144, TINUVIN 622LD, MARK LA57, MARK LA67, MARK LA62, MARK LA68 and MARK LA63.

Thioether type antioxidant: SUMILIZER TPS and SUMILIZER TP-D.

Phosfite type antioxidant: MARK 2112, MARK PEP 8, MARK PEP 24G, MARK PEP 36, MARK 329K and MARK HP 10.

Among those, preferable are hidered phenol type and hindered amine type particularly.

The added amount of antioxidants is preferably between 0.1 and 100 weight parts per 100 weight parts of the total resin layer composition.

The layer configuration of the electrophotographic photoreceptor of the present invention is not particularly limited. However, the preferred configuration is one in which the resin layer of the present invention is applied onto a photosensitive layer, such as a charge generating layer, a charge transport layer, or a charge generating-transport layer (a single layer type photosensitive layer which has both functions of charge generation and charge transport). Further, each of said charge generating layer, charge transport layer or charge generating-charge transport layer may be comprised of a plurality of layers.

The charge generating materials (CGM) incorporated into the photosensitive layer of the present invention may be employed individually or in combination with a suitable binder resin to form a resin layer. The representative examples of the charge generating materials include, for example, pyrylium dyes, thiopyrylium dyes, phthalocyanine pigments, anthanthrone pigments, dibenzpyrenequinone pigments, pyranthrone pigments, azo pigments, trisazo pigments, disazo pigments, indigo pigments, quinacridone pigments, cyanine dyes etc.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

In the present invention, the ratio of the charge generating material in the charge generating layer to the binder resin is preferably between 1:5 and 5:1 in terms of weight ratio. Further, the thickness of the charge generating layer is preferably no more than 5 $\mu$m, and is more preferably between 0.05 and 2 $\mu$m.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 3:1 and 1:3 in terms of weight ratio.

The thickness of the charge transport layer is preferably between 5 and 50 $\mu$m, and is more preferably between 10 and 40 $\mu$m. Furthermore, when a plurality of charge transport layers are provided, the thickness of the upper charge transport layer is preferably no more than 10 $\mu$m, and is preferably less than the total layer thickness of the charge transport layer provided under the upper layer of the charge transport layer.

The hardenable siloxane resin layer may share the function of the aforementioned charge transport layer. However, the hardenable siloxane resin layer is preferably provided as another layer on a photosensitive layer such as a charge transport layer or a charge generating layer, or a single layer type charge generating-transport layer. In such cases, an adhesive layer is preferably provided between the aforementioned photosensitive layer and the resin layer of the present invention.

Next, listed as an electrically conductive support of the electrophotographic photoreceptor of the present invention are:

1) metal plates such as an aluminum plate, a stainless steel plate, and the like
2) those in which a thin layer of metal such as aluminum, palladium, gold, and the like is provided on a support such as paper, plastic film , and the like, employing lamination or vacuum evaporation
3) those in which the layer of an electrically conductive compound such as an electrically conductive polymer, indium oxide, tin oxide, and the like is provided on a support such as paper, plastic film, and the like, employing coating or vacuum evaporation, and the like.

Employed mainly as materials for the electrically conductive support employed in the present invention are metals such as aluminum, copper, brass, steel stainless steel, and the like, as well as plastics. Any of these is processed in a belt shape or drum shape, and then employed. Commonly to thin-walled cylindrical aluminum tubes produced by extrusion or drawing are frequently employed.

The electrically conductive support of the electrophotographic photoreceptor of the present invention is one in which a sealed alumite film on its surface is formed.

An alumite film forming process is generally carried out in an acidic bath comprising, for instance, chromic acid, sulfuric acid, oxalic acid, phosphoric acid, boric acid, sulfamic acid, and the like. Of these, the anodic oxidation in sulfuric acid results in the most preferred form. The anodic oxidation in sulfuric acid is preferably carried out at a sulfuric acid concentration of 100 to 200 g/liter, an aluminum ion concentration of 1 to 10 g/liter, a temperature of about 20° C., and an electrolytic voltage of about 20 volts. However, the present invention is not limited to these conditions.

Further, the average thickness of the layer formed by said anodic oxidation is commonly no more than 20 $\mu$m, and is preferably no more than 10 $\mu$m.

In the present invention, the film formed by the anodic oxidation as described above is subjected to sealing to enhance the stability of the resulting film, and subsequently employed. Sealing methods include, for example, low temperature sealing in which the film is immersed in an aqueous solution comprising nickel fluoride as the main component, high temperature sealing in which the film is immersed in an aqueous solution comprising, for instance, nickel acetate as the main component, steam sealing, boiling-water sealing, and the like. However, the present invention is not limited to these sealing methods. The aqueous nickel acetate solution is preferably employed at a concentration of 5 to 10 g/liter, a processing temperature of 80 to 95° C., and a pH of 5 to 6. If desired, the film formed by the anodic oxidation, as described above, may be subjected to cleaning employing pure water and the like, and then dried.

Listed as specific examples of the processing methods are the methods described in Japanese Patent Publication Open to Public Inspection Nos. 2-7070, 3-212648, 5-80565, and 9-15886.

The roughened state of the electrically conductive support employed in the present invention is preferably between 0.3 and 2.5 $\mu$m in terms of 10-point average surface roughness Rz, and is more preferably between 0.6 and 2.0 $\mu$m.

Figure 2:
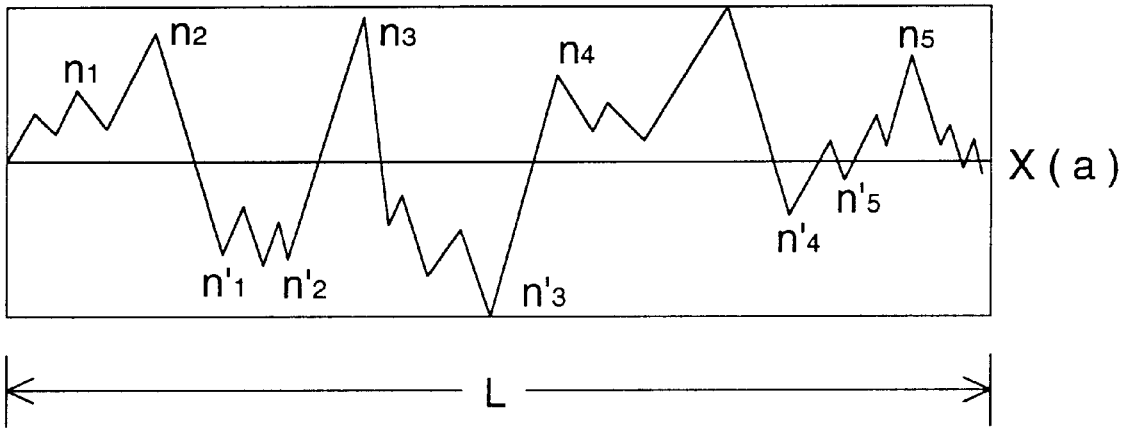
FIG. 2 is a schematic view of demonstrating the evaluating 10 points average surface roughness Rz.

Further, FIG. 2 is a schematic view to explain the calculating method of 10-point average surface roughness Rz. Rz as described herein means the difference between the average height of five peaks and the average depth of five depressions between length L (250 $\mu$m in the present invention). Rz is calculated by the formula;

$$Rz=[(n1 \ldots +n5)-(n'1 \ldots +n'5)]/5.$$

In FIG. 2, average line X (a) is a line in which the sum of the squared distance between each point on the roughness curve and the average line X is minimal said 10-point average roughness Rz was measured employing a light tracer type surface roughness tester SURCOM 470A (manufactured by Tokyo Seimitsu Co.), provided with light tracer type pickup E-DT-SL024.

When the 10-point average roughness Rz is no more than 0.3 $\mu$m, adhesive properties are insufficient, and when a laser beam source is employed as the light source, commercial viability is not obtained due to the formation of moire. Further, when Rz is at least 2.5 $\mu$m, problems occur in which processing streaks appear on the images.

Preferably employed methods to roughen the surface of an electrically conductive support include, for untreated cylinders comprised of metal such as aluminum and the like, a method in which the metal surface is subjected to specular surface polishing and then to fine grooving employing a diamond bit, and a method in which the surface of an untreated cylinder is roughened employing sand blasting.

The shape of the support may be a drum, sheet or belt, and is preferably optimum for the electrophotographic apparatus to which the support is applied.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

The photosensitive layer is prepared by heat drying at temperature of more than 50° C. or higher, preferably 60 to 200° C. after forming the surface layer by coating. The residual coating solvent can be reduced and at the same time, the hardenable layer can be hardened sufficiently. In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (nylon 6, nylon 66, nylon 610, copolymerized nylon, alkoxymethylated nylon, etc.), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 μm, and is most preferably between 0.1 and 5 μm.

In the photoreceptor of the invention a conductive layer may be provided between the support and the inter layer for the purposes of providing a coating to compensate surface defects of the surface of the support and preventing of occurrence of interference mottle which becomes problematic when the image writing source is laser light. The conductive layer can be formed by coating a composition in which conductive powder such as carbon black, metal particles or metal oxide particles are dispersed in suitable binder resin and drying it. The thickness of the conductive layer is preferably 5 to 40 μm, particularly 10 to 30 μm.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

FIG. 1 shows a cross-sectional view of an image forming apparatus comprising the electrophotographic photoreceptor of the present invention.

In FIG. 1, reference numeral 10 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 11 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 1 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 10, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means, which is not shown in the figure, so as to form a layer having a thickness of 100 to 600 μm on the development sleeve, and conveyed to a development zone to achieve development. At the time, development is generally carried out by applying direct current and/or alternative current bias voltage to the gap between the photoreceptor drum 10 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 10.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 10 in synchronized transfer timing, and multicolor images are simultaneously transferred onto the recording sheet which is appropriately placed.

Subsequently, the recording sheet is subjected to charge elimination employing separation brush (in the separation unit) 19 which is brought into pressure contact at almost the same time when the transfer roller is brought into pressure contact, is separated from the circumferential surface of the photoreceptor drum 10, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 10 and are prepared for the subsequent formation of a new toner image.

On the other hand, the photoreceptor drum 10, from which the recording sheet P has been separated, is subjected to removal and cleaning of the residual toner through pressure contact of the blade 221 of cleaning unit 22, is again subjected to charge elimination employing the exposure section 11, subjected to recharging employing the charging unit 12, and subjected to a subsequent image forming process. Further, when color images are formed upon being superimposed on the photoreceptor, the above-mentioned blade 221 is immediately withdrawn after cleaning the photoreceptor surface of the photoreceptor drum.

Further, reference numeral 30 is a detachable cartridge in which a photoreceptor, a transfer unit, a separation unit, and a cleaning unit are integrated.

The present electrophotographic image forming apparatus is constituted in such a manner that components such as the above-mentioned photoreceptor, development unit, cleaning unit the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

EXAMPLES

The present invention will now be detailed with reference to examples below.

Example 1

A photoreceptor was prepared as described below.

<Electrically Conductive Support>

A 360 mm long cylindrical aluminum tube drawn at a diameter of 80 mm was subjected to degreasing-cleaning, employing organic solvents, and subsequent etching. After washing in water, it was immersed in 7 percent nitric acid at 25° C. for one minute and after an additional water wash, was subjected to anodic oxidation in an electrolytic solution containing sulfuric acid in an amount of 180 g/liter at a current density of 1.0 A/dm$^2$ to form an alumite film having an average thickness of 6 $\mu$m. After water washing, the resultant was then subjected to sealing by being immersed in an aqueous solution containing 10 g/liter of a sealing agent comprised of nickel acetate as the main component at 90° C. for 20 minutes. Subsequently, the resultant was washed with pure water and finally dried.

| <Charge Generating Layer> | |
|---|---|
| Charge generating material: titanyl phthalocyanine (having a maximum peak of 27.3° of Bragg angle 2θ at Cu-Kα X-ray diffraction) | 60 g |
| Silicone resin solution (KR5240, 15% xylene-butanol solution, manufactured by Shin-Etsu Kagaku Co.) | 700 g |
| Methyl ethyl ketone | 1000 ml |

were mixed and the resultant mixture was dispersed for 10 hours employing a sand mill to prepare a charge generating layer coating composition. The resulting coating composition was applied onto the aforementioned electrically conductive support, employing a dip coating method to form a charge generating layer having a layer thickness of 0.2 $\mu$m.

| <Charge Transport Layer> | |
|---|---|
| Charge transport material (D1) | 200 g |
| Bisphenol Z type polycarbonate (UPIRON Z300, manufactured by Mitsubishi Gas Kagaku Co.) | 300 g |
| 1,2-Dichloroethane | 2000 ml |

were mixed and dissolved to prepare a charge transport layer it coating composition. The resultant coating composition was applied onto the aforementioned charge generating layer, employing a dip coating method to form a 25 $\mu$m thick charge transport layer.

D1

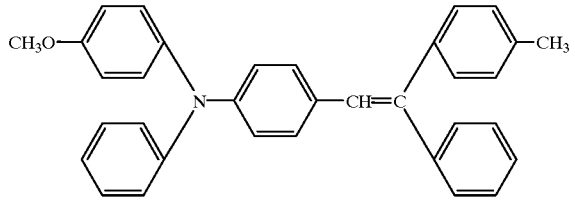

Commercially available Primer PC-7J (manufactured by Shin-Etsu Kagaku Co.) was diluted to one half concentration with toluene, and was then applied onto the resulting coating.

After coating, drying was carried out at 100° C. for 30 minutes to form an adhesive layer having a dry layer thickness of 0.3 $\mu$m.

Added to 10 weight parts of a polysiloxane resin (comprising one percent by weight of a silanol group) having 80 mole percent of methylsiloxane units and 20 mole percent of methyl-phenylsiloxane units 10 weight parts of molecular sieve 4A, and the resultant mixture was left undisturbed for 15 hours and dehydrated. The resultant resin was dissolved in 10 weight parts of toluene, and 5 weight parts of methyltrimethoxysilane and 0.2 weight part of dibutyl tin acetate were added so as to prepare a uniform solution.

Added to the resultant solution were 6 weight parts of dihydroxymethyltriphenylamine (Exemplified Compound T-1) and then blended. The resulting mixture was applied onto the resulting coating so as to form a protective layer having a dry layer thickness of 1 $\mu$m, and subsequently dried at 120° C. for one hour to form the photoreceptor of Example 1.

The resulting photoreceptor was installed on a KONICA 7050 (a laser digital copier, manufactured by Konica Corp., provided with a cartridge integrally comprised of a photoreceptor, a charging unit, a development unit, a cleaning unit, and a charge eliminating unit) was evaluated while setting an initial charge potential at −650 V.

In ambient conditions of 20° C. and 60% RH, and 30° C. and 80% RH, employing A4 size sheets of paper, images on the initial and the 50,000th copy were evaluated. In both ambient conditions, neither the initial copy nor 50,000th copy resulted in background staining, and resulted in a density of at least 1.2 in terms of the reflection density in the solid black areas, as well as images with excellent consistency. Further, after completion of a total of 100,000 copies, including copies at both ambient conditions for each of 50,000 copies, the decrease in thickness of the photoreceptor due to abrasion was very small to be such as no more than 0.1 μm. Further, flaws on the photoreceptor surface were hardly noticed and image problems in particular peeling of photosensitive layer on the halftone images due to abrasion were also hardly noticed.

Comparative Example 1

A photoreceptor of Comparative Example 1 was prepared in the same manner as Example 1, except that dihydroxymethyltriphenylamine in Example 1 was replaced with triphenylamine.

Evaluation was carried out in the same manner as the aforementioned Example 1. The results showed that good images were obtained at an ambient condition of 20° C. and 60% RH, while at an ambient condition of 30° C. and 80% RH, background staining occurred on the image of the 50,000th copy, and image blurring also resulted in portions of the image. Further, at completion of a total of 100,000 copies, including copies at both ambient conditions for each of 50,000 copies, the decrease in thickness of the photoreceptor due to abrasion was 0.9 ||m, which was greater compared to the photoreceptor of the present invention. Image defects and peeling of the photosensitive layer were observed.

Comparative Example 2

Comparative Example 2 photoreceptor was prepared in the same manner as Example 1, except that the electrically conductive support in Example 1 was replaced with a specular surfaced one.

Evaluation was carried out in the same manner as the aforementioned Example 1. The results showed that at the completion of the 30,000th copy at an ambient condition of 20° C. and 60% RH, image problems due to photoreceptor layer peeling occurred.

Example 2

<Electrically Conductive Support>

A 360 mm long cylindrical specular surfaced aluminum tube with a diameter of 80 mm was subjected to degreasing-cleaning, employing organic solvents, and subsequently etched. After washing in water, it was subjected to anodic oxidation at a direct current voltage of 20 V for 15 minutes, employing sulfuric acid in an amount of 150 g/liter, while maintaining a temperature at 20° C. to form an alumite film at a film thickness of 7 μm. After washing in water, the resultant was then subjected to sealing by immersion at 90° C. for 5 minutes in an aqueous solution containing 6 g/liter of a sealing agent comprised of nickel acetate as the main component. Subsequently, the resultant was washed with pure water and lastly dried.

Example 2 photoreceptor was prepared in the same manner as Example 1, except that the electrically conductive aluminum support of Example 1 was replaced with the aforementioned one, and the polysiloxane resin was replaced with a polysiloxane resin, (comprising 2 percent by weight of a silanol group), comprised of 80 mole percent of methylsiloxane units and 20 mole percent of dimethylsiloxane units.

Example 3

Example 3 photoreceptor was prepared in the same manners as Example 1, except that the polysiloxane resin of Example 1 was replaced with one (comprising 2 percent by weight of a silanol group) comprised of 30 mole percent of methylsiloxane units, 40 mole percent of ethylsiloxane units, 20 mole percent of dimethylsiloxane units, and 10 mole percent of diethylsiloxane units.

Example 4

Example 4 photoreceptor was prepared in the same manners as Example 1, except that the polysiloxane resin of Example 1 was replaced with one (comprising 2 percent by weight of a silanol group) comprised of 30 mole percent of methylsiloxane units, 30 mole percent of phenylsiloxane units, 20 mole percent of dimethylsiloxane units, and 20 mole percent of diethylsiloxane units.

Example 5

Example 5 photoreceptor was prepared in the same manners as Example 1, except that dihydroxymethyltriphenylamine (Exemplified Compound T-1) of Example 1 was replaced with a hydrazone based one (Exemplified Compound H-1).

Example 6

Example 6 photoreceptor was prepared in the same manners as Example 1, except that dihydroxymethyltriphenylamine (Exemplified Compound T-1) of Example 1 was replaced with a stilbene based one (Exemplified Compound S-1).

Example 7

Example 7 photoreceptor was prepared in the same manners as Example 1, except that dihydroxymethyltriphenylamine (Exemplified Compound T-1) of Example 1 was replaced with a benzidine based one (Exemplified Compound Be-1).

Example 8

Example 8 photoreceptor was prepared in the same manners as Example 1, except that dihydroxymethyltriphenylamine (Exemplified Compound T-1) of Example 1 was replaced with a butadiene based one (Exemplified Compound Bu-1).

Example 9

Example 9 photoreceptor was prepared in the same manners as Example 1, except that dihydroxymethyltriphenylamine (Exemplified Compound T-1) of Example 1 was replaced with Exemplified Compound So-1.

Example 10

Example 10 photoreceptor was prepared in the same manners as Example 1, except that dihydroxymethyltriphenylamine (Exemplified Compound T-1) of Example 1 was replaced with Exemplified Compound V-1.

Example 11

Example 11 photoreceptor was prepared in the same manners as Example 1, except that dihydroxymethyltriphenylamine (Exemplified Compound T-1) of Example 1 was replaced with Exemplified Compound W-1.

Example 12

Example 12 photoreceptor was prepared in the same manners as Example 5, except that for Example 5, 5 weight parts of colloidal silica were added to the protective layer.

Example 13

Example 13 photoreceptor was prepared in the same manners as Example 6, except that for Example 6, 12 weight parts of colloidal silica were added to the protective layer.

Example 14

Example 14 photoreceptor was prepared in the same manners as Example 7, except that for Example 7, 10 weight parts of colloidal silica were added to the protective layer.

Example 15

Example 15 photoreceptor was prepared in the same manners as Example 8, except that for Example 8, 15 weight parts of colloidal silica were added to the protective layer.

Example 16

Example 16 photoreceptor was prepared in the same manners as Example 9, except that for Example 9, 20 weight parts of colloidal silica were added to the protective layer.

Example 17

A sample, which was comprised of the adhesive layer together with the preceding layers, was prepared in the same manner as Example 1.

Added to 60 weight parts of a commercially available hardenable siloxane resin KP-854 (manufactured by Shin-Etsu Kagaku Kogyo Co.) were 60 weight parts of isopropanol, and were uniformly dissolved. In the same manner as Example 16 weight parts of dihydroxymethyltriphenylamine (Exemplified Compound T-1) were added to the resulting solution. The resulting solution was applied onto said layer so as to obtain a protective layer having a dried layer thickness of 1 μm and then dried at 120° C. for one hour to obtain an Example 17 photoreceptor.

Example 18

Example 18 photoreceptor was prepared in the same manners as Example 17, except that siloxane resin KP-854 of Example 17 was replaced with X-40-2239 (manufactured by Shin-Etsu Kagaku Kogyo Co.).

Example 19

Example 19 photoreceptor was prepared in the same manners as Example 17, except that siloxane resin KP-854 of Example 17 was replaced with X-40-2269 (manufactured by Shin-Etsu Kagaku Kogyo Co.).

Photoreceptors of Examples 2 through 19 were evaluated in the same manners as for Example 1 photoreceptor.

In both ambient conditions of 20° C. at 60% RH, and 30° C. In at 80% RH, the initial copy as well as the 50,000th copy resulted in no background staining, and resulted in a density of at least 1.2 in terms of the reflection density in the solid black area, as well as images with excellent consistency. Further, at the completion of the 50,000th copy, the decrease in thickness of the photoreceptor due to abrasion was very small being no more than 0.1 μm. Further, flaws on the photoreceptor surface were hardly noticed and image problems on the halftone images due to abrasion were also hardly noticed. Particularly peeling of the photosensitive layer was not noticed.

Comparative Example 3

Comparative Example 1 photoreceptor was prepared in the same manner as Example 1, except that after forming the alumite film, the electrically conductive support of Example 1 was not subjected to sealing.

Evaluation was carried out in the same manner as for the aforementioned Example 1. The results showed that good images were obtained at an ambient condition of 20° C. at 60% RH, while at the ambient condition of 30° C. at 80% RH, image problems of black spots on a white background occurred after copying of 20,000 sheets.

Example 20

Example 20 photoreceptor was prepared in the same manner as Example 1, except that dihydroxymethyltriphenylamine in the protective layer of Example 1 was replaced with 4-[2-(triethoxysilyl)ethyl]triphenylamine.

Evaluation was carried out in the same manner as for the aforementioned Example 1. The results showed that good images were obtained at an ambient condition of 20° C. at 60% RH, while at the ambient condition of 30° C. at 80% RH, image blurring in a portion of the images occurred after copying 50,000 sheets. Further, after copying 100,000 sheets, including 50,000 sheets for both ambient conditions, the decrease in thickness of the photoreceptor due to abrasion was 0.6 μm which was greater compared to other Examples. However peeling of the photosensitive layer was not noticed.

Example 21

Example 21 photoreceptor was prepared in the same manners as Example 1, except that in Example 1, the interlayer described below was provided between the electrically conductive support and the charge generating layer.

| <Interlayer> | |
|---|---|
| Zirconium chelate compound ZC-540 (manufactured by Matsumoto Seiyaku Co., Ltd.) | 200 g |
| Silane coupling agent KBM-903 (Shin-Etsu Kagaku Co., Ltd.) | 100 g |
| Methanol | 700 ml |
| Ethanol | 300 ml |

The above materials were applied employing a dip coating method and subsequently dried at 150° C. for 30 minutes to form a 1.0 μm thick interlayer.

Example 22

Example 22 photoreceptor was prepared in the same manners as Example 1, except that in Example 1, 0.9 weight part of a hindered phenol amine compound (Exemplified Compound 1-10) was added.

Example 23

Example 23 photoreceptor was prepared in the same manner as Example 1, except that in Example 1, 0.6 weight part of a hindered phenol amine compound (Exemplified Compound 2-1) was added.

Photoreceptors of Examples 21, 22, and 23 were evaluated in the same manner as for Example 1.

In both ambient conditions of 20° C. at 60% RH, and 30° C. at 80% RH, neither the initial copy nor 100,000th copy resulted in background staining, and resulted in a density of at least 1.3 in terms of the reflection density in the solid black area, as well as images with excellent consistency. Further, at the completion of the 100,000th copy, the decrease in thickness of the photoreceptor due to abrasion was very small being no more than 0.1 μm. Further, flaws on the photoreceptor surface were hardly noticed and image problems on the halftone images due to abrasion were also hardly noticed. Particularly, peeling of the photoreceptor was not noticed.

Example 24

A photoreceptor sample was prepared in the following way.

<Conductive Support>

A cylindrical aluminum tube having diameter of 80 mm and length of 360 mm having roughness (adjusted by sand blast treating) 1.5 μm, was subjected to process of forming an alumite film, sealing, washing and drying as Example 1, to obtain electrically conductive support.

| <Inter Layer> | |
|---|---|
| Polyamide resin (CM8000, manufactured by Toray) | 60 g |
| Methanol | 2000 ml |

The coating composition was coated on the cylindrical aluminum tube by dip coating method, and dried at room temperature. Inter layer having 0.3 μm thickness was formed.

| <Charge Generating Layer> | |
|---|---|
| Charge generating material: titanyl phthalocyanine (having a maximum peak of 27.3° of Bragg angle 2θ at Cu-Kα X-ray diffraction) | 60 g |
| Silicone resin solution (KR5240, 15% xylene-butanol solution, manufactured by Shin-Etsu Kagaku Co.) | 700 g |
| Methyl ethyl ketone | 1000 ml |

were mixed and the resultant mixture was dispersed for 10 hours employing a sand mill to prepare a charge generating layer coating composition. The resulting coating composition was applied onto the aforementioned electrically conductive support, employing a dip coating method to form a charge generating layer having a layer thickness of 0.2 μm.

| <Charge Transport Layer> | |
|---|---|
| Charge transport material (D1) | 200 g |
| Bisphenol Z type polycarbonate (UPIRON Z300, manufactured by Mitsubishi Gas Kagaku Co.) | 300 g |
| 1,2-Dichloroethane | 2000 ml |

were mixed and dissolved to prepare a charge transport layer coating composition. The resultant coating composition was applied onto the aforementioned charge generating layer, employing a dip coating method to form a 25 μm thick charge transport layer.

D1

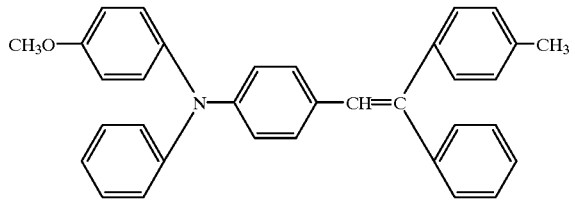

Commercially available Primer PC-7J (manufactured by Shin-Etsu Kagaku Co.) was diluted to one half concentration with toluene, and was then applied onto the resulting coating. After coating, drying was carried out at 100° C. for 30 minutes to form an adhesive layer having a dry layer thickness of 0.3 μm.

Added to 10 weight parts of a polysiloxane resin (comprising one percent by weight of a silanol group) having 80 mole percent of methylsiloxane units and 20 mole percent of methyl-phenylsiloxane units 10 weight parts of molecular sieve 4A, and the resultant mixture was left undisturbed for 15 hours and dehydrated. The resultant resin was dissolved in 10 weight parts of toluene, and 5 weight parts of methyltrimethoxysilane and 0.2 weight part of dibutyl tin acetate were added so as to prepare a uniform solution.

Added to the resultant solution were 6 weight parts of dihydroxymethyltriphenylamine (Exemplified Compound T-1) and then blended. The resulting mixture was applied onto the resulting coating so as to form a protective layer having a dry layer thickness of 1 μm, and subsequently dried at 120° C. for one hour to form the photoreceptor of Example 24.

The surface roughness Rz of the photoreceptor sample was 0.7 μm.

The resulting photoreceptor was installed on a KONICA 7050 (a laser digital copier, manufactured by Konica Corp., provided with a cartridge integrally comprised of a photoreceptor, a charging unit, a development unit, a cleaning unit, and a charge eliminating unit) was evaluated while setting an initial charge potential at −650 V.

In ambient conditions of 20° C. and 60% RH, and 30° C. and 80% RH, employing A4 size sheets of paper, images on the initial and the 50,000th copy were evaluated. In both ambient conditions, neither the initial copy nor 50,000th copy resulted in background staining, and resulted in a density of at least 1.2 in terms of the reflection density in the solid black areas, as well as images with excellent consistency. Further, after completion of a total of 100,000 copies, including copies at both ambient conditions for each of 50,000 copies, the decrease in thickness of the photoreceptor due to abrasion was very small to be such as no more than 0.1 μm. Further, flaws on the photoreceptor surface were hardly noticed and image problems on the halftone images due to abrasion were also hardly noticed.

Example 25

Example 25 photoreceptor was prepared in the same manner as Example 24, except that the electrically conductive support in of Example 24 was replaced with that having surface roughness Rz of 2.4 μm, and the polysiloxane resin was replaced with a polysiloxane resin, (comprising 2 percent by weight of a silanol group), comprised of 80 mole percent of methylsiloxane units and 20 mole percent of dimethylsiloxane units.

The surface roughness Rz of the photoreceptor sample was 1.2 μm.

Example 26

Example 26 photoreceptor was prepared in the same manners as Example 24, except that the electrically conductive support of Example 24 was replaced with that having surface roughness Rz of 1.0 μm, and that the polysiloxane resin of Example 24 was replaced with one (comprising 2 percent by weight of a silanol group) comprised of 30 mole percent of methylsiloxane units, 40 mole percent of ethylsiloxane units, 20 mole percent of dimethylsiloxane units, and 10 mole percent of diethylsiloxane units.

The surface roughness Rz of the photoreceptor sample was 0.4 μm.

Example 27

Example 27 photoreceptor was prepared in the same manners as Example 24, except that the electrically conductive support of Example 24 was replaced with that having surface roughness Rz of 0.4 μm, and that th e polysiloxane resin of Example 1 was replaced with one (comprising 2 percent by weight of a silanol group) comprised of 30 mole percent of methylsiloxane units, 30 mole percent of phenylsiloxane units, 20 mole percent of dimethylsiloxane units, and 20 mole percent of diethylsiloxane units.

The surface roughness Rz of the photoreceptor sample was 0.02 μm.

Example 28

Example 28 photoreceptor was prepared in the same manners as Example 24, except that the electrically conductive support of Example 24 was replaced with that having surface roughness Rz of 2.0 μm, and that dihydroxymethyltriphenylamine (Exemplified Compound T-1) of Example 1 was replaced with a hydrazone based one (Exemplified Compound H-1).

The surface roughness Rz of the photoreceptor sample was 0.9 μm.

Example 29

Example 29 photoreceptor was prepared in the same manners as Example 25, except that dihydroxymethyltriphenylamine (Exemplified Compound T-1) of Example 25 was replaced with a stilbene based one (Exemplified Compound S-1) and that the thickness of the charge transfer layer was changed to 24 μm.

The surface roughness Rz of the photoreceptor sample was 0.4 μm.

Example 30

Example 30 photoreceptor was prepared in the same manners as Example 26, except that dihydroxymethyltriphenylamine (Exemplified Compound T-1) of Example 26 was replaced with a benzidine based one (Exemplified Compound Be-1) and that the thickness of the charge transfer layer was changed to 22 μm.

The surface roughness Rz of the photoreceptor sample was 0.8 μm

Example 31

Example 31 photoreceptor was prepared in the same manners as Example 27, except that dihydroxymethyltriphenylamine (Exemplified Compound T-1) of Example 27 was replaced with a butadiene based one (Exemplified Compound Bu-1) and that the thickness of the charge transfer layer was changed to 18 μm.

The surface roughness Rz of the photoreceptor sample was 1.1 μm.

Example 32

Example 32 photoreceptor was prepared in the same manners as Example 24, except that dihydroxymethyltriphenylamine (Exemplified Compound T-1) of Example 24 was replaced with Exemplified Compound So-1 and that the thickness of the charge transfer layer was changed to 215 μm.

The surface roughness Rz of the photoreceptor sample was 1.2 μm

Example 33

Example 33 photoreceptor was prepared in the same manners as Example 24, except that dihydroxymethyltriphenylamine (Exemplified Compound T-1) of Example 1 was replaced with Exemplified Compound V-1.

The surface roughness Rz of the photoreceptor sample was 0.8 μm.

Example 34

Example 34 photoreceptor was prepared in the same manners as Example 24, except that dihydroxymethyltriphenylamine (Exemplified Compound T-1) of Example 24 was replaced with Exemplified Compound W-1.

The surface roughness Rz of the photoreceptor sample was 0.7 μm.

Example 35

Example 35 photoreceptor was prepared in the same manners as Example 28, except that for Example 28, 5 weight parts of colloidal silica were added to the protective layer.

The surface roughness Rz of the photoreceptor sample was 1.2 μm.

Example 36.

Example 36 photoreceptor was prepared in the same manners as Example 29, except that for Example 29, 12 weight parts of colloidal silica were added to the protective layer.

The surface roughness Rz of the photoreceptor sample was 0.5 μm.

Example 37

Example 37 photoreceptor was prepared in the same manners as Example 30, except that for Example 30, 10 weight parts of colloidal silica were added to the protective layer.

The surface roughness Rz of the photoreceptor sample was 1.0 μm.

Example 38

Example 38 photoreceptor was prepared in the same manners as Example 31, except that for Example 31, 15 weight parts of colloidal silica were added to the protective layer.

The surface roughness Rz of the photoreceptor sample was 1.1 μm.

Example 39

Example 39 photoreceptor was prepared in the same manners as Example 32, except that for Example 32, 20 weight parts of colloidal silica were added to the protective layer.

The surface roughness Rz of the photoreceptor sample was 1.3 μm.

Example 40

A sample, which was comprised of the adhesive layer in together with the preceding layers, was prepared in the same manner as Example 24.

Added to 60 weight parts of a commercially available hardenable siloxane resin KP-854 (manufactured by Shin-Etsu Kagaku Kogyo Co.) were 60 weight parts of isopropanol, and were uniformly dissolved. In the same manner as Example 16 weight parts of dihydroxyrethyltriphenylamine (Exemplified Compound T-1) were added to the resulting solution. The resulting solution was applied onto said layer so as to obtain a protective layer having a dried layer thickness of 1 μm and then dried at 120° C. for one hour to obtain an Example 40 photoreceptor.

The surface roughness Rz of the photoreceptor sample was 0.6 μm.

Example 41

Example 41 photoreceptor was prepared in the same manners as Example 40, except that siloxane resin KP-854 of Example 40 was replaced with X-40-2239 (manufactured by Shin-Etsu Kagaku Kogyo Co.).

The surface roughness Rz of the photoreceptor sample was 0.7 μm.

Example 42

Example 42 photoreceptor was prepared in the same manners as Example 40, except that siloxane resin KP-854 of Example 40 was replaced with X-40-2269 (manufactured by Shin-Etsu Kagaku Kogyo Co.).

The surface roughness Rz of the photoreceptor sample was 0.8 μm.

Photoreceptors of Examples 25 through 42 were evaluated in the same manners as for Example 24 photoreceptor.

In both ambient conditions of 20° C. at 60% RH, and 30° C. at 80% RH, the initial copy as well as the 50,000th copy resulted in no background staining, and resulted in a density of at least 1.2 in terms of the reflection density in the solid black area, as well as images with excellent consistency. Further, at the completion of the 50,000th copy, the decrease in thickness of the photoreceptor due to abrasion was very small being no more than 0.1 μm. Further, flaws on the photoreceptor surface were hardly noticed and image problems on the halftone images due to abrasion were also hardly noticed.

Example 43

Example 43 photoreceptor was prepared in the same manner as Example 24, except that dihydroxymethyltriphenylamine in the protective layer of Example 1 was replaced with 4-[2-(triethoxysilyl)ethyl]triphenylamine.

The surface roughness Rz of the photoreceptor sample was 0.7 μm.

Evaluation was carried out in the same manner as for the aforementioned Example 24. The results showed that good images were obtained at an ambient condition of 20° C. at 60% RH, while at the ambient condition of 30° C. at 80% RH, image blurring in a portion of the images occurred after copying 50,000 sheets. Further, after copying 100,000 sheets, including 50,000 sheets for both ambient conditions, the decrease in thickness of the photoreceptor due to abrasion was 0.6 μm which was greater compared to other Examples.

Comparative Example 4

A photoreceptor of Comparative Example 4 was prepared in the same manner as Example 24, except that dihydroxymethyltriphenylamine in Example 24 was replaced with triphenylamine.

The surface roughness Rz of the photoreceptor sample was 0.7 μm.

Evaluation was carried out in the same manner as the aforementioned Example 24. The results showed that good images were obtained at an ambient condition of 20° C. And 60% RH, while at an ambient condition of 30° C. and 80% RH, background staining occurred on the image of the 50,000th copy, and image blurring also resulted in portions of the image. Further, at completion of a total of 100,000 copies, including copies at both ambient conditions for each of 50,000 copies, the decrease in thickness of the photoreceptor due to abrasion was 0.9 μm, which was greater compared to the photoreceptor of the present invention.

Comparative Example 5

Comparative Example 5 photoreceptor was prepared in the same manner as Example 24, except that the electrically conductive support in Example 24 was replaced with that having surface roughness of 0.2 μm.

The surface roughness Rz of the sample was 0.01 μm.

Evaluation was carried out in the same manner as for the aforementioned Example 24. Moire was found at half tone part from the first imaging. The results showed that at the completion of the 30,000th copy at an ambient condition of 20° C. and 60% RH, image problems due to photoreceptor layer peeling occurred.

Comparative Example 6

Comparative Sample 6 was prepared in the same manner as Example 25, except that the dihydroxymethyltriphenylamine in the protective layer of Example 25 was replaced by triphenylamine.

The surface roughness Rz of the photoreceptor sample was 1.2 μm.

Evaluation was carried out in the same manner as the aforementioned Example 24. The results showed that good images were obtained at an ambient condition of 20° C. and 60% RH, while at an ambient condition of 30° C. and 80% RH, background staining occurred on the image of the 50,000th copy, and image blurring also resulted in portions of the image. Further, at completion of a total of 100,000 copies, including copies at both ambient conditions for each of 50,000 copies, the decrease in thickness of the photoreceptor due to abrasion was 0.8 μm, which was greater compared to the photoreceptor of the present invention.

Comparative Example 7

Comparative Example 7 photoreceptor was prepared in the same manner as Example 24, except that the electrically conductive support of Example 24 was replaced with that having surface roughness Rz of 2.7 μm.

The surface roughness Rz of the photoreceptor sample was 2.1 μm.

Evaluation was carried out in the same manner as the aforementioned Example 24. The results showed that uneven streaks were found and good images other than uneven streaks were obtained at an ambient condition of 20° C. and 60% RH, while at an ambient condition of 30° C. and 80% RH, cleaning defects due to trans-through of non-transferred toner occurred on the image of the 20,000th copy, and thereby image blurring resulted.

Example 44

Example 44 photoreceptor was prepared in the same manners as Example 1, except that in Example 24, the interlayer described below was provided between the electrically conductive support and the charge generating layer.

| <Interlayer> | |
|---|---|
| Zirconium chelate compound ZC-540 (manufactured by Matsumoto Seiyaku Co., Ltd.) | 200 g |
| Silane coupling agent KBM-903 (Shin-Etsu Kagaku Co., Ltd.) | 100 g |
| Methanol | 700 ml |
| Ethanol | 300 ml |

The above materials were applied employing a dip coating method and subsequently dried at 150° C. for 30 minutes to form a 1.0 μm thick interlayer.

The surface roughness Rz of the photoreceptor sample was 0.3 μm.

Example 45

Example 45 photoreceptor was prepared in the same manners as Example 24, except that in Example 24, 0.9 weight part of a hindered phenol amine compound (Exemplified Compound 1-10) was added.

The surface roughness Rz of the photoreceptor sample was 0.4 μm.

Example 46

Example 46 photoreceptor was prepared in the same manner as Example 24, except that in Example 24, 0.6 weight part of a hindered phenol amine compound (Exemplified Compound 2-1) was added.

The surface roughness Rz of the photoreceptor sample was 0.6 μm.

Photoreceptors of Examples 44, 45, and 46 were evaluated in the same manner as for Example 24.

In both ambient conditions of 20° C. at 60% RH, and 30° C. at 80% RH, neither the initial copy nor 100,000th copy resulted in background staining, and resulted in a density of at least 1.3 in terms of the reflection density in the solid black area, as well as images with excellent consistency. Further, at the completion of the 100,000th copy, the decrease in thickness of the photoreceptor due to abrasion was very small being no more than 0.1 μm. Further, flaws on the photoreceptor surface were hardly noticed and image problems on the halftone images due to abrasion were also hardly noticed. Further, peeling of the photoreceptor was not noticed.

According to the present invention, it is possible to prevent film peeling of photoreceptor and insufficient image caused by it, in the photoreceptor improved in image quality by forming alumite layer. Further it is possible to provide an electrophotographic photoreceptor which exhibits high wear resistance, stable electrophotographic properties at high temperature and humidity during repeated use, and produces excellent images during repeated use, when digital images are formed employing a laser beam, and to provide a processing cartridge and an image forming apparatus using said photoreceptor.

What is claimed is:

1. An electrophotographic photoreceptor comprising an electrically conductive support having thereon a photosensitive layer, wherein a surface layer of said electrophotographic photoreceptor is comprised of a resin layer containing a hardenable siloxane resin obtained by allowing an organic silicon compound having a hydroxyl group or a hydrolyzable group to react with a charge transferable compound having an amino group, and said electrically conductive support comprises on its surface a sealed alumite film, said hardenable siloxane resin having a partial structural unit having a charge transportability represented by structural formula

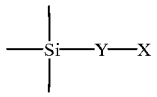

wherein X represents a charge transportability providing group which bonds to Y via a carbon atom which is contained in said providing group, and Y represents O, S, or NR, wherein R represents H or a univalent organic group.

2. An electrophotographic photoreceptor comprising an electrically conductive support having thereon a photosensitive layer, wherein a surface layer of said electrophotographic photoreceptor is comprised of a resin layer containing a hardenable siloxane resin obtained by allowing an organic silicon compound having a hydroxyl group or a hydrolyzable group to react with a charge transferable compound having a mercapto group, and said electrically conductive support comprises on its surface a sealed alumite film.

3. An electrophotographic photoreceptor comprising:

an electrically conductive support having thereon a sealed alumite film; and a photosensitive layer provided on said electrically conductive support, wherein a surface layer of said electrophotographic photoreceptor comprises, a hardened siloxane resin having a partial structural unit having a charge transportability represented by structural formula

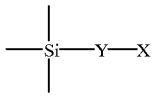

wherein X represents a charge transportability providing group which bonds to Y via a carbon atom which is contained in said providing group, and Y represents O, S, or NR, wherein R represents H or a univalent organic group.

4. The electrophotographic photoreceptor of claim 3, wherein said photosensitive layer is comprised of a charge generating layer and a charge transport layer.

5. The electrophotographic photoreceptor of claim 3, wherein an interlayer is provided between said electrically conductive support and said photosensitive layer.

6. The electrophotographic photoreceptor of claim 5, wherein said interlayer is a resin layer.

7. The electrophotographic photoreceptor of claim 5, wherein said interlayer is a resin layer formed by allowing an organic metal compound to react with an organic metal chelate compound.

8. The electrophotographic photoreceptor of claim 3, wherein the thickness of said surface layer is between 0.1 and 20 $\mu$m.

9. The electrophotographic photoreceptor of claim 3, wherein an adhesive layer is provided between said surface layer and an adjacent layer.

10. The electrophotographic photoreceptor of claim 3, wherein said charge transportability providing group is a triarylamine based compound residual group.

11. The electrophotographic photoreceptor of claim 3, wherein said charge transportability providing is a hydrazone based compound residual group.

12. The electrophotographic photoreceptor of claim 3, wherein said charge transportability providing group is a styryltriphenylamine group.

13. The electrophotographic photoreceptor of claim 3, wherein said charge transportability providing group is a benzidine group.

14. The electrophotographic photoreceptor of claim 3, wherein said charge transportability providing group is a butadiene based compound residual group.

15. The electrophotographic photoreceptor of claim 3, wherein said electrophotographic photoreceptor comprises an antioxidant.

16. The electrophotographic photoreceptor of claim 15, wherein said antioxidant is a compound having a hindered phenol, hindered amine, thioether, or phosphite.

* * * * *